US007938266B2

(12) United States Patent
Cross

(10) Patent No.: US 7,938,266 B2
(45) Date of Patent: May 10, 2011

(54) DISPENSING CONTAINER DEVICE

(75) Inventor: Harley Cross, Los Angeles, CA (US)

(73) Assignee: Hint Mint, Inc., Los Angeles, CA (US)

( * ) Notice: Subject to any disclaimer, the term of this patent is extended or adjusted under 35 U.S.C. 154(b) by 0 days.

(21) Appl. No.: 12/802,507

(22) Filed: Jun. 8, 2010

(65) Prior Publication Data

US 2010/0243665 A1 Sep. 30, 2010

Related U.S. Application Data

(62) Division of application No. 12/052,131, filed on Mar. 20, 2008, now Pat. No. 7,757,858.

(51) Int. Cl.
*B65D 83/04* (2006.01)

(52) U.S. Cl. ..... 206/540; 220/282; 220/315

(58) Field of Classification Search ..... 206/37, 206/38, 528, 530, 533, 534.1, 534.2, 536, 206/538, 540; 220/282, 315, 324, 326; 229/108
See application file for complete search history.

(56) References Cited

U.S. PATENT DOCUMENTS

| | | | | | |
|---|---|---|---|---|---|
| 564,103 | A | * | 7/1896 | Richardson | 206/533 |
| 2,219,487 | A | * | 10/1940 | Nyden | 206/534.2 |
| 2,492,864 | A | * | 12/1949 | Hermani | 206/540 |
| 2,655,259 | A | * | 10/1953 | Davoren | 206/534.2 |
| 2,722,309 | A | * | 11/1955 | Waterman | 206/534.2 |
| 4,991,759 | A | * | 2/1991 | Scharf | 206/63.5 |

* cited by examiner

*Primary Examiner* — Luan K Bui
(74) *Attorney, Agent, or Firm* — Lewis Brisbois Bisgaard & Smith LLP

(57) ABSTRACT

A dispensing container device for dispensing small solids such as pills, tablets, or candy, or liquids such as emulsions, gels, solvents, or aqueous solutions, comprising a base, a cover, and an insert. The base has a bottom wall and a curvilinear side wall having an upper edge, the side wall having an aperture. The cover has an upper wall and a curvilinear side wall having a lower edge. The insert has an upper wall and a curvilinear side wall and has an aperture which corresponds with at least some portion of the aperture in the base side wall when the insert is placed within the base. When the cover, base, and insert are assembled, placement of pressure on the cover upper wall or on the base bottom wall reveals the aperture in the base side wall and in the corresponding insert side wall, permitting the dispensing of the device's contents.

2 Claims, 7 Drawing Sheets

FIG. 2
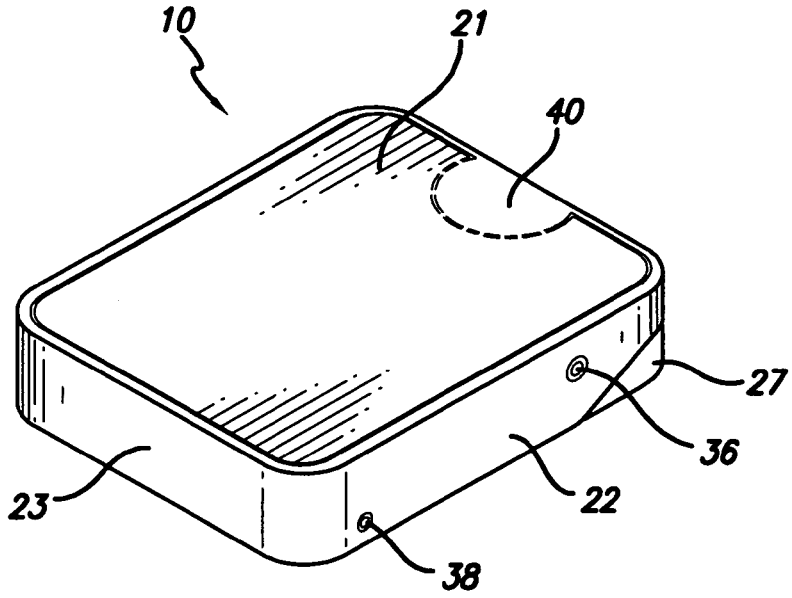
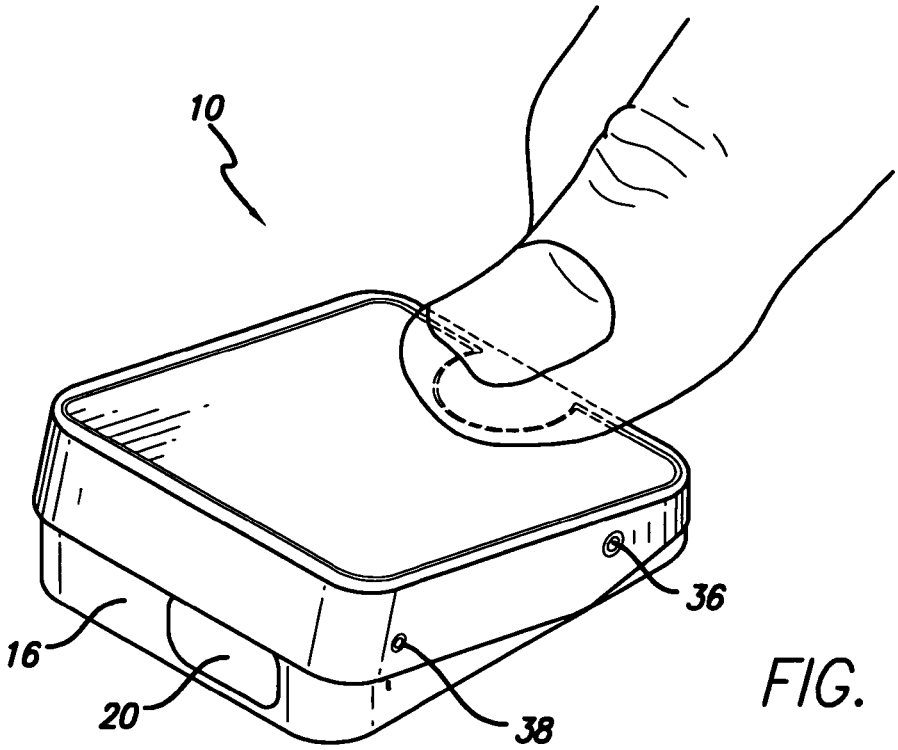
FIG. 3

DISPENSING CONTAINER DEVICE

This application is a divisional of parent application, application Ser. No. 12/052,131 filed on Mar. 20, 2008, the disclosure of which is incorporated herein by reference.

FIELD OF INVENTION

The present dispenser relates generally to the field of small containers with the capability of functioning as a dispenser. More particularly, the invention relates to a container for dispensing small solids such as pills, tablets, or candy, or liquids such as emulsions, gels, solvents, or aqueous solutions, wherein a cover is configured to a base such that when a portion of the cover or base is pressed, the device opens up thereby allowing its contents to be dispensed through an aperture.

BACKGROUND

Small containers for storing and dispensing items are often comprised of various moving parts such as lids, caps, covers, seals, or hinged openings. Also, dispensers with a press-top configuration are generally well-known in the art.

The present invention provides a dispensing container device that is convenient to carry and operate, and adapted for readily dispensing small solids such as pills, tablets, or candy, or liquids such as emulsions, gels, solvents, or aqueous solutions. The present invention permits the opening of the device, dispensing of its contents, and closing of the device using a single hand, if desired. Additionally, the present invention permits the dispensing of its contents without having to reach into the dispenser or touch its contents.

SUMMARY

The present invention comprises a dispensing device which functions as a container for holding and dispensing items small solids such as pills, tablets, or candy, or liquids such as emulsions, gels, solvents, or aqueous solutions, with a cover assembled to a base. One embodiment of the present invention comprises a base with a bottom wall, side walls, a front wall with an aperture, and a rear wall, each wall having an upper edge. The cover has an upper wall, side walls, a front wall and a rear wall, each wall having a lower edge. A portion of the upper edge of each base side wall is angled such that the resulting upper edge of the base rear wall is lower than the base front wall. A portion of the lower edge of each cover side wall is also angled such that the resulting lower edge of the cover rear wall is higher than the cover front wall. When the cover and base are assembled, placement of downward pressure on a rear area of the cover upper wall elevates the cover front wall, revealing some portion of the aperture, thereby permitting the dispensing of at least some of the contents of the dispenser.

The present invention also comprises a dispensing device that includes an insert. The insert has an aperture in its front wall which corresponds with at least some portion of the aperture in the front wall of the base when the insert is placed in the base. The insert is shaped in such fashion that would allow the exposure of at least some portion of the aperture in the front wall of the base when pressure is applied on the rear portion of the cover or base.

The present invention also comprises a dispensing device with interacting detents provided on the cover and base for retaining the cover and base in a closed configuration. Interacting detents can also be provided to prevent disengagement of the cover and base when the device is in its open configuration.

The present invention also comprises a dispensing device wherein the bottom wall, side wall, front wall, or rear wall of the base is curvilinear.

The present invention also comprises a dispensing device wherein the upper wall, side wall, front wall, or rear wall of the cover is curvilinear.

The present invention also comprises a dispensing device of various geometric shapes, including but not limited to multi-sided shapes, for example, triangular, rectangular, square, or hexagonal, and curved shapes such as oval, circular, elliptical, or pear shape.

It is to be understood that both the foregoing summary merely provides an example of how the dispensing device's inventive aspects may be put into practice, and is not intended to limit the broad spirit and scope of the inventive aspects.

BRIEF DESCRIPTION OF THE DRAWINGS

In the drawings, to which reference will be made in the specification, reference numbers are used in the Figures to indicate certain components, aspects, or features shown therein. Reference symbols common to more than one Figure indicate like components, aspects, or features shown therein.

FIG. 2 is a perspective view of the dispenser of FIG. 1 in its closed configuration;

FIG. 3 is a perspective view of the dispenser of FIG. 2 in its open configuration, showing a finger depressing a rear portion of the cover to expose the aperture in the base;

DETAILED DESCRIPTION

Figure 1:
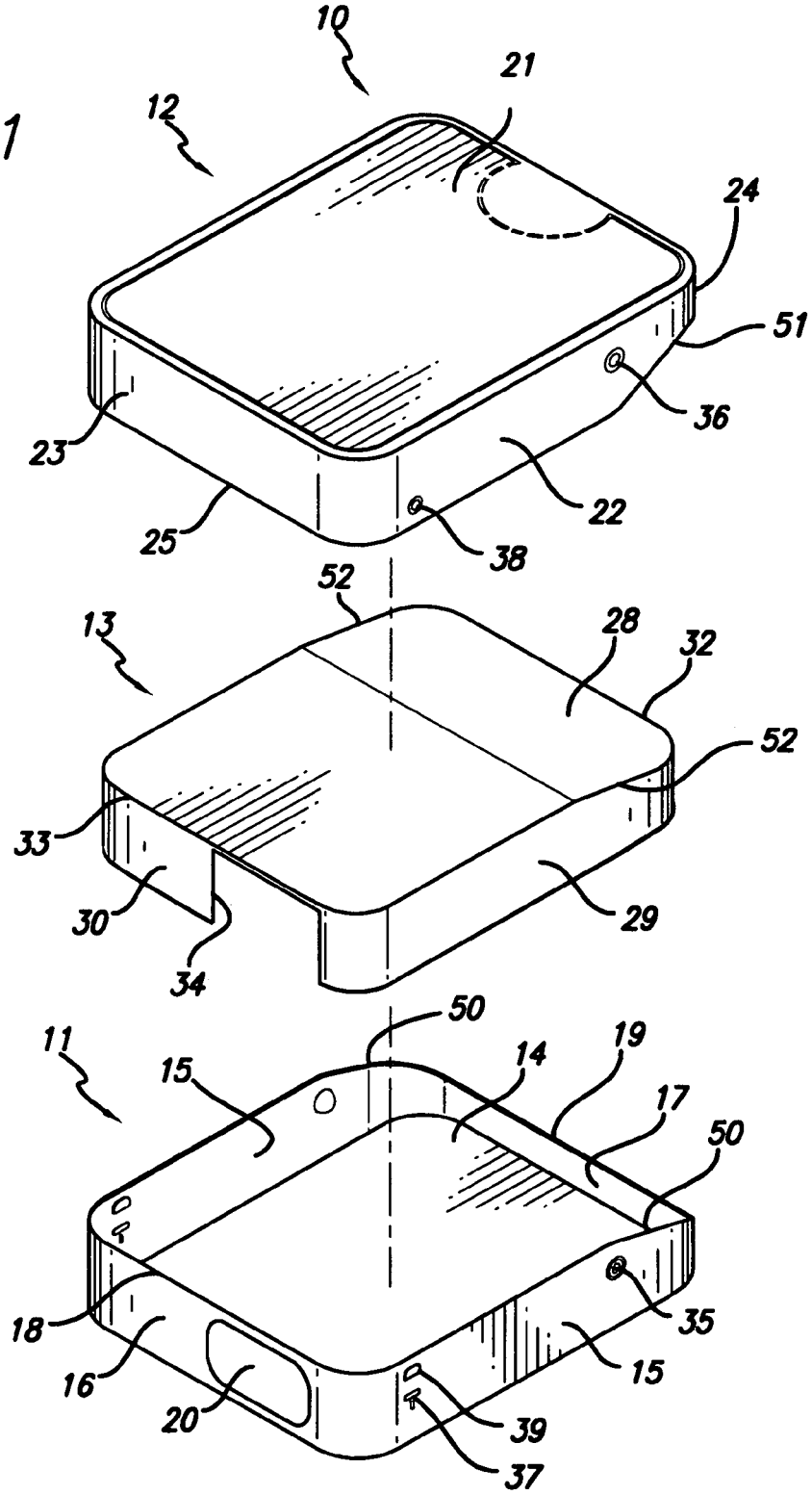
FIG. 1 is an exploded perspective view of an embodiment of the dispenser, showing the cover, the insert, and the base.
Figure 8:
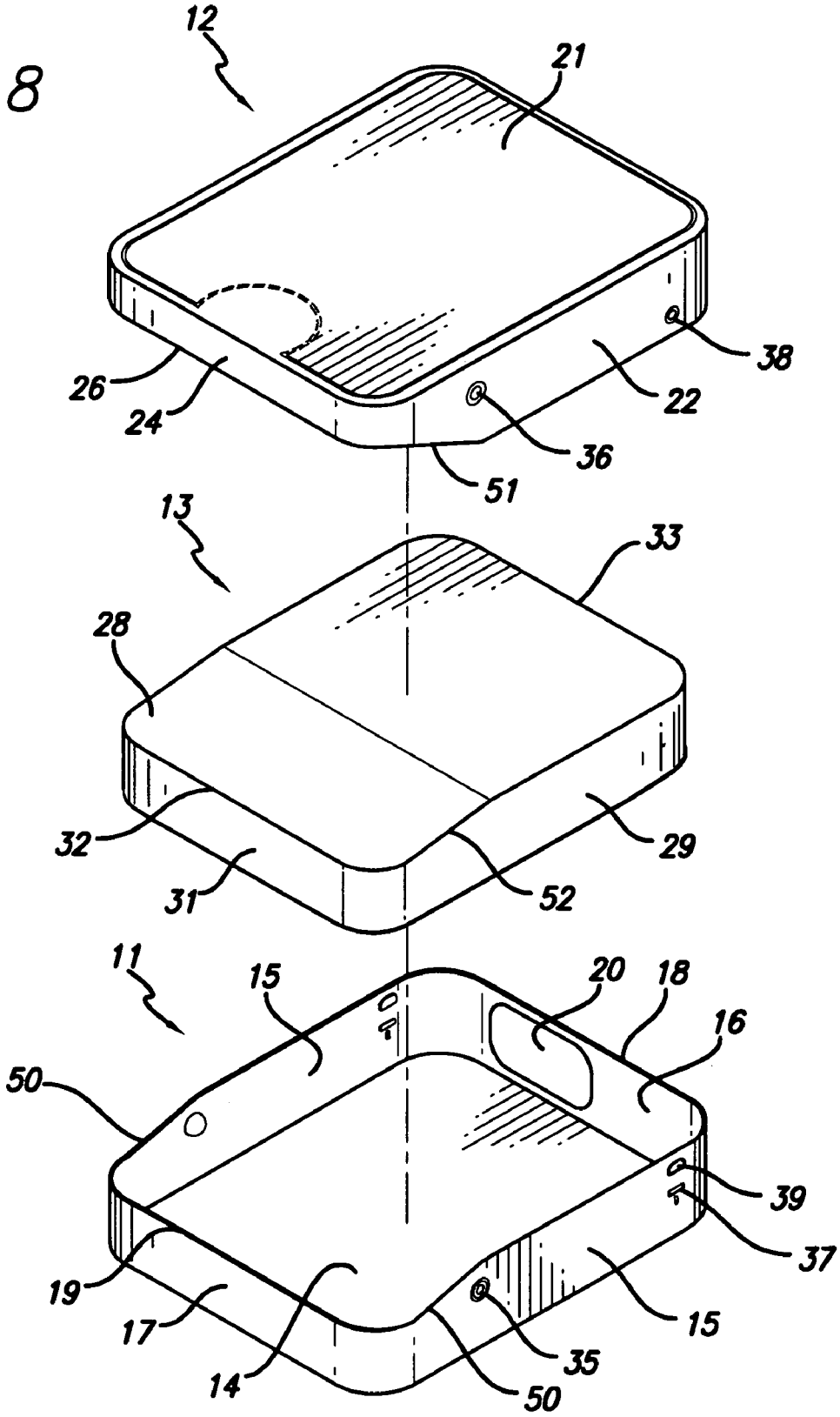
FIG. 8 is an exploded rear perspective view of the dispenser of FIG. 1.

In accordance with a preferred embodiment of the present invention, the dispensing device shown in FIGS. 1, 2, and 8, generally indicated by reference number 10 comprises broadly: a base 11 and a cover 12.

As shown in FIGS. 1, 2, and 8, the base 11 is comprised of a bottom wall 14, at least two opposing side walls 15 (both indicated by reference number 15), a front wall 16 and a rear wall 17, each wall having an upper edge. The upper edge of the base front wall is indicated by reference number 18 and the upper edge of the base rear wall indicated by reference number 19. A portion 50 of the upper edge of each base side wall is angled such that the resulting upper edge of the base rear wall 19 is lower than the upper edge of the base front wall 18. The base front wall 16 has at least one aperture 20. The aperture 20 can be varied in size, shape, and location in the base front wall 16.

As shown in FIGS. 1, 2, and 8, the cover 12 is comprised of an upper wall 21, at least two opposing side walls 22, a front wall 23 and a rear wall 24, each wall having a lower edge. The lower edge of the cover front wall 23 is indicated by reference number 25 and the lower edge of the cover rear wall is indicated by reference number 26. A portion 51 of the lower edge of each cover side wall is angled such that the resulting lower edge of the cover rear wall 26 is higher than the lower edge of the cover front wall 25.

As shown in FIGS. 2 and 3, when the cover 12 and base 11 are assembled, a portion 27 of the base is exposed, whereupon placement of downward pressure on a rear area of the cover upper wall 21, such as at location 40, elevates the cover front wall 23, revealing some portion of the aperture 20 in the base front wall 16, thereby permitting the dispensing of at least some of the contents of the dispenser.

Figure 9:
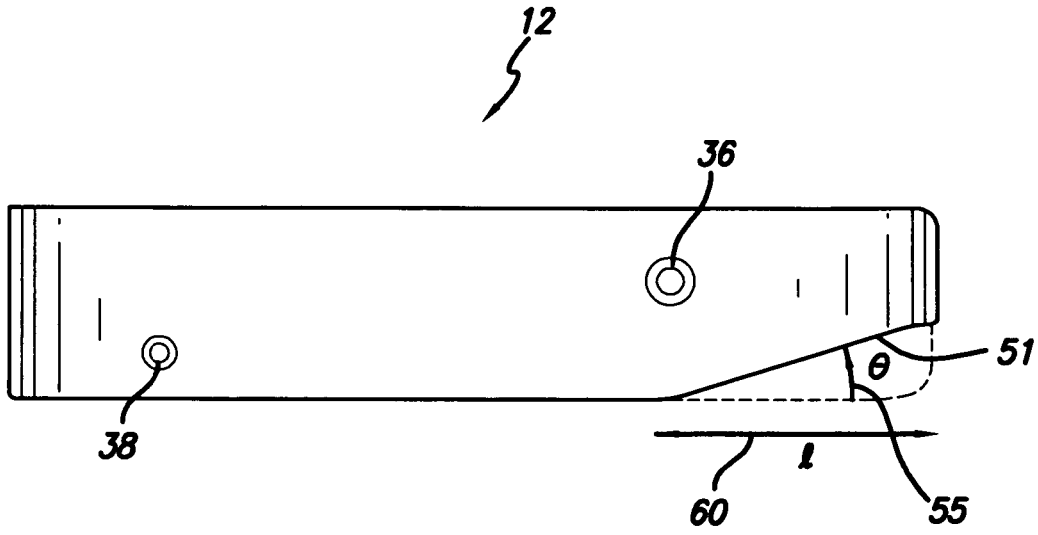
FIG. 9 is a side elevation view of the cover of the dispenser of FIG. 1, with specific references to the angled portions of the lower edge of the cover side wall.
Figure 10:
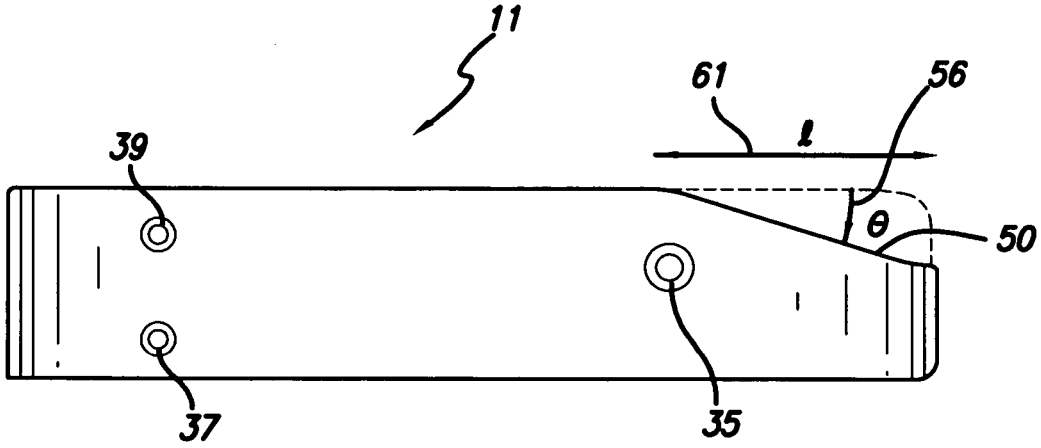
FIG. 10 is a side elevation view of the base of the dispenser of FIG. 1, with specific references to the angled portions of the upper edge of the base side wall.

The angled portions 50 and 51 of the base and the cover, respectively, allow the front wall 23 of the cover 12 to be elevated when pressure is applied to the cover or base, thereby revealing the aperture 20 in the base front wall 30. As will be appreciated by those skilled in this field numerous embodiments may be constructed with corresponding angled portions 50 and 51, adjusted depending on the size, thickness, and length of the dispensing device, or to vary the degree in which the cover front wall 23 is elevated when downward pressure is applied to the cover or base. Referring to FIGS. 9 and 10, in alternate embodiments, the angles (θ) 55 and 56 and lengths 60 and 61 of the corresponding angled portions 51 and 50 of the cover and the base, respectively, can be increased or decreased, in order to vary the degree in which the aperture 20 is exposed, or to vary the degree in which the cover front wall 23 elevates. The angles (θ) 55 and 56 in FIGS. 9 and 10 are each measured to be about 17 degrees, however these angles can be adjusted to a degree greater than 0, but less than 90 degrees.

Another embodiment of the present dispensing device comprises an insert 13. The insert holds the contents in place, such as in the event the cover is disengaged. Also, small solids such as tablets tend to "stack" inside a dispensing device, and the insert permits the dispensing device to open and close when stacking occurs. This optional insert is preferred if the size of the contents of the dispensing device is small enough to "stack" thereby preventing the depression of the cover onto the base. The insert can also be removably or permanently fixed to the base.

Figure 4:
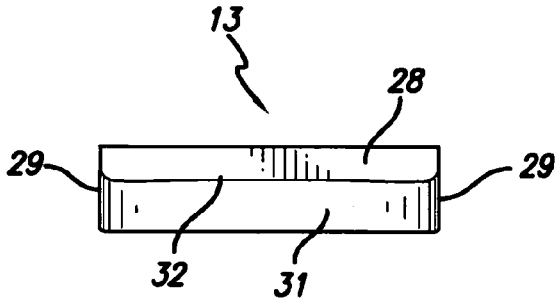
FIG. 4 is a side elevation view of the insert in FIG. 1, showing the rear wall of the insert, and the portion of the insert's upper wall angled downwards towards the base end wall.
Figure 5:
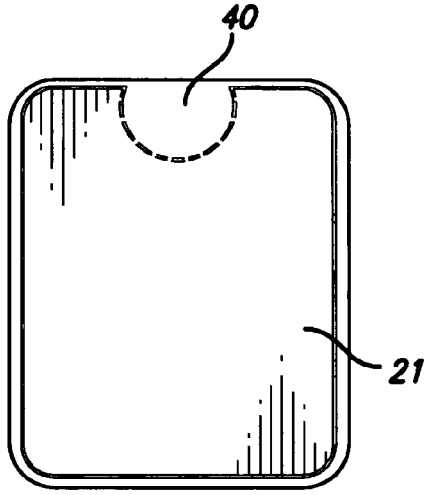
FIG. 5 is a top plan view of the cover of the dispenser of FIG. 1.
Figure 6:
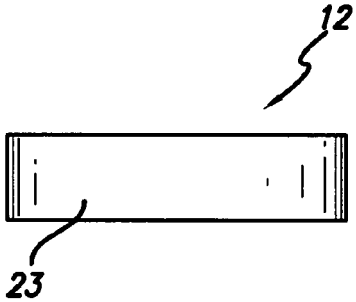
FIG. 6 is a side elevation view of the cover of the dispenser of FIG. 1.
Figure 7:
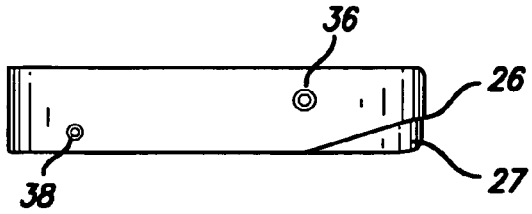
FIG. 7 is a side elevation view of the dispenser of FIG. 1 in its closed configuration, displaying the interacting detents.

As shown in FIGS. 1, 4, and 8, the insert 13 can be comprised of an upper wall 28, at least two opposing side walls 29, a front wall 30 and a rear wall 31. The front wall 30 and rear wall 31 of the insert 13 both have upper edges. The upper edge of the front wall of the insert is indicated by reference number 33, and the upper edge of the rear wall of the insert is indicated by reference number 32. A portion 52 of each of the upper edge of each side wall 29 of the insert is angled, such that the resulting upper edge 32 of the rear wall is lower than the upper edge 33 of the front wall. The insert 13 has at least one aperture 34 in the front wall 30 which corresponds with at least some portion of the aperture 20 in the base front wall 16 when the insert 13 is placed within the base 11.

Another embodiment of the present dispensing device includes interacting detents on the base and cover. These interacting detents assist in maintaining the cover in its closed position and also assists in maintaining the cover in its open position. These interacting detents also make it more difficult for the cover or the base to be disengaged, and can also reduce the likelihood of disengagement of the cover or base when the device is at the limit of its open configuration. These detents can be comprised of an interacting corresponding pair of inwardly-directed female detent and outwardly-directed male detent, and can also be comprised of fasteners such as by way of example and without limitation, screws, bolts and nuts, or any other type of fasteners that will permit the dispenser to function for its intended purpose.

As an example as to how the detents work, we now refer to FIGS. 1, 2, 3, 7, and 8. In the illustrative embodiments shown in these figures, the detent 35 of the base 11 interacts with and engages detent 36 of the cover 12 to assist in maintaining the dispensing device in its closed configuration (FIG. 2), thereby retaining its contents, and also to assist in maintaining the device in its open configuration (FIG. 3), thereby allowing the dispensing of its contents while fixed in the open configuration. Likewise, detent 37 of the base 11 interacts with and engages detent 38 of the cover 12 to assist in maintaining the device 10 in its closed configuration, thereby making it more difficult for the cover or the base to be disengaged. Detent 39 of the base 11 interacts with and engages detent 38 of the cover 12 to help maintain the device in its open configuration, reducing the likelihood of disengagement of the cover or base when the device is at the limit of its open configuration.

There can also be additional detents on the base or cover. And there can also be detents at alternative locations than what is described herein. For example, in an alternative embodiment, the detent 38 could be located instead on the cover front wall 23 and the corresponding detents 37 and 39 could be located on the cover front wall 23 and base front wall 16, respectively, to maintain the device in its closed configuration and prevent disengagement when it is at the limit of its open configuration. Alternatively, the detent 35 located at the rear area of the base side wall 15 and detent 36 located at the rear area of the cover side wall 22, can be replaced by fasteners, screws, nuts and bolts, or any other suitable material known in the art, so that the base 11 and the cover 12 are rotatably engaged (i.e., allowing rotation, like a pivot) either permanently or removably, at this point.

Opening the dispenser of FIG. 2 can be done in several ways one of which is by applying downward pressure on the rear area of the upper wall 21 of the cover 11, as shown in FIG. 3. The dispenser of FIG. 2 can also be opened by applying pressure on the rear area of the base bottom wall 14. Opening the dispenser can be done by one finger, by placing the dispenser on a surface as shown in FIG. 3, or by grasping the container between two opposing fingers, simultaneously pressing with two fingers—with one finger on the cover 12, and another finger on the base 11.

Closing the dispenser of FIG. 3 can also be done in several ways, one of which is by applying downward pressure on the front area of the cover upper wall 21. The dispenser of FIG. 3 can also be closed by applying pressure on the front area of the base bottom wall 14. Closing the dispenser can be also done by one finger, by placing the dispenser on a surface, or by grasping the container between two opposing fingers, simultaneously pressing with two opposing fingers—with one finger on the cover 12, and another finger on the base 11.

Figure 11:
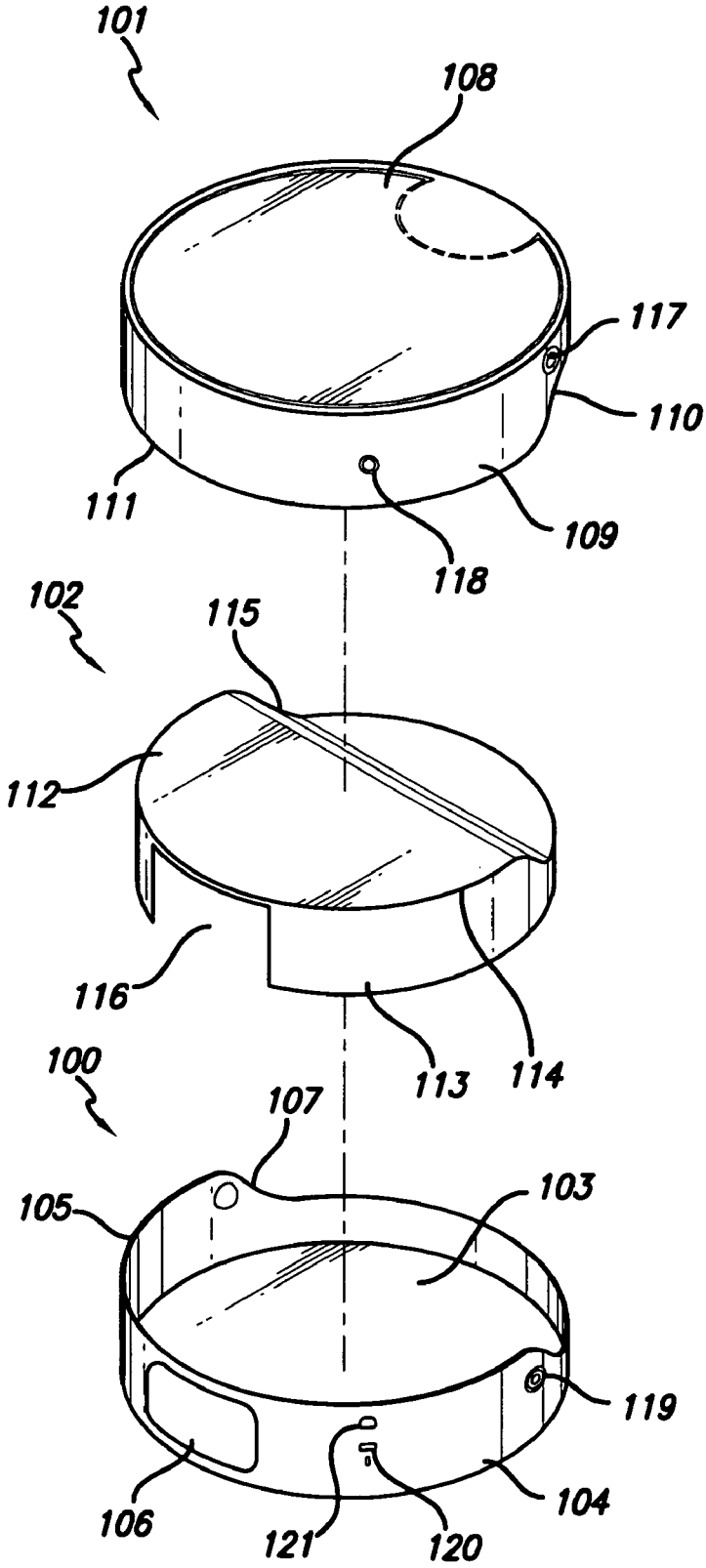
FIG. 11 is an exploded perspective view of a curved shaped embodiment of the dispenser, showing the cover, the insert, and the base.

Another embodiment of the present invention is a dispensing device of curved geometric shape, for example, oval, circular, elliptical, or pear shape. Shown in FIG. 11 is a dispensing device in the shape of a circle. Specifically, in this embodiment, the dispenser is broadly comprised of a base 100 and a cover 101. The base 100 has a bottom wall 103 and a curvilinear side wall 104 with an upper edge 105. The base side wall has at least one aperture 106. A portion 107 of the upper edge of the base side wall, opposite the aperture 106, is angled downward such that the upper edge of that portion of the base side wall is lower than the remaining upper edge of the base side wall. The cover 101 has an upper wall 108 and a curvilinear side wall 109 having a lower edge 111. A portion 110 of the lower edge of the cover side wall, opposite the aperture 106 of the base side wall, is angled upward such that the lower edge of that portion 110 of the cover side wall is higher than the remaining lower edge of the cover side wall. Upon assembly of the cover 101 and base 100, a portion of the base wall is exposed, such that placement of downward pressure on an area of the cover upper wall 108 across the aperture in the base side wall elevates the cover wall 109, revealing some portion of the aperture 106 in the base side wall, thereby permitting the dispensing of at least some of the contents of the dispenser.

The angled portions 107 and 110 of the base 100 and the cover 101, respectively, allow the cover wall 109 to be elevated when pressure is applied on an area of the cover upper wall 108, thereby revealing the aperture 106 of the base side wall. As will be appreciated by those skilled in this field numerous embodiments may be constructed with corresponding angled portions 107 and 110 of the base and cover, respectively, which are adjusted depending on the size, thickness, and length of the dispensing device, or to vary the degree in which the cover wall 109 is elevated when downward pressure is applied to the cover or base. In alternate embodiments, the angles of the corresponding angled portions 107 and 110 of the base 100 and the cover 101, respectively, can be increased or decreased, in order to vary the degree in which the aperture 106 is exposed, or to vary the degree in which the cover front wall 109 elevates.

Opening the dispenser of FIG. 11 can be done in several ways one of which is by applying downward pressure on an area of the cover upper wall 108, as shown in FIG. 11. Opening the dispenser can be done by one finger, by placing the dispenser on a flat surface, or by grasping the container between two opposing fingers, simultaneously pressing with two fingers—with one finger on the on an area of the cover upper wall 108, and another finger on the bottom of the base 100.

Closing the dispenser of FIG. 11 can also be done in several ways, one of which is by applying downward pressure on the front area of the cover 101. The dispenser of FIG. 11 can also be closed by applying pressure on the bottom of the base 100. Closing the dispenser can be also done by one finger, by placing the dispenser on a flat surface, or by grasping the container between two opposing fingers, simultaneously pressing with two opposing fingers—with one finger on the on an area of the cover upper wall 108, and another finger on the bottom of the base 100.

Another embodiment of the present invention is a dispensing device in the shape of a circle, oblong, oval, ellipsis, or pear, as described above, with an insert 102 (as also shown in FIG. 11). The insert holds the contents in place, such as in the event the cover is disengaged. Also, small solids such as tablets tend to "stack" inside a dispensing device, and the insert permits the dispensing device to open and close when stacking occurs. This optional insert is preferred if the size of the contents of the dispensing device is small enough to "stack" thereby preventing the depression of the cover onto the base. The insert can also be removably or permanently fixed to the base.

As shown in FIG. 11, the insert 102 has an upper wall 112 and a curvilinear side wall 113 with an upper edge 114. A portion 115 of the upper edge of the side wall of the insert is angled downward such that the upper edge of that portion of the insert side wall is lower than the remaining upper edge 114. The insert 102 has at least one aperture 116 in the curvilinear side wall which corresponds with at least some portion of the aperture 106 in the base side wall when the insert 102 is placed within the base 100.

The dispensing device of FIG. 11 can also include interacting detents on the base 100 and the cover 101. In the embodiment shown in FIG. 11, the detent 119 of the base 100 interacts with and engages detent 117 of the cover 101, to assist in maintaining the dispensing device in its closed configuration, thereby retaining its contents, and also to assist in maintaining the device in its open configuration, thereby allowing the dispensing of its contents while fixed in the open configuration. Likewise, detent 120 of the base 100 interacts with and engages detent 118 of the cover 101 to assist in maintaining the device in its closed configuration, thereby making it more difficult for the cover or the base to be disengaged. Detent 121 of the base 100 interacts with and engages detent 118 of the cover 101 to help maintain the device in its open configuration, reducing the likelihood of disengagement of the cover or base when the device is at the limit of its open configuration.

Figure 12:
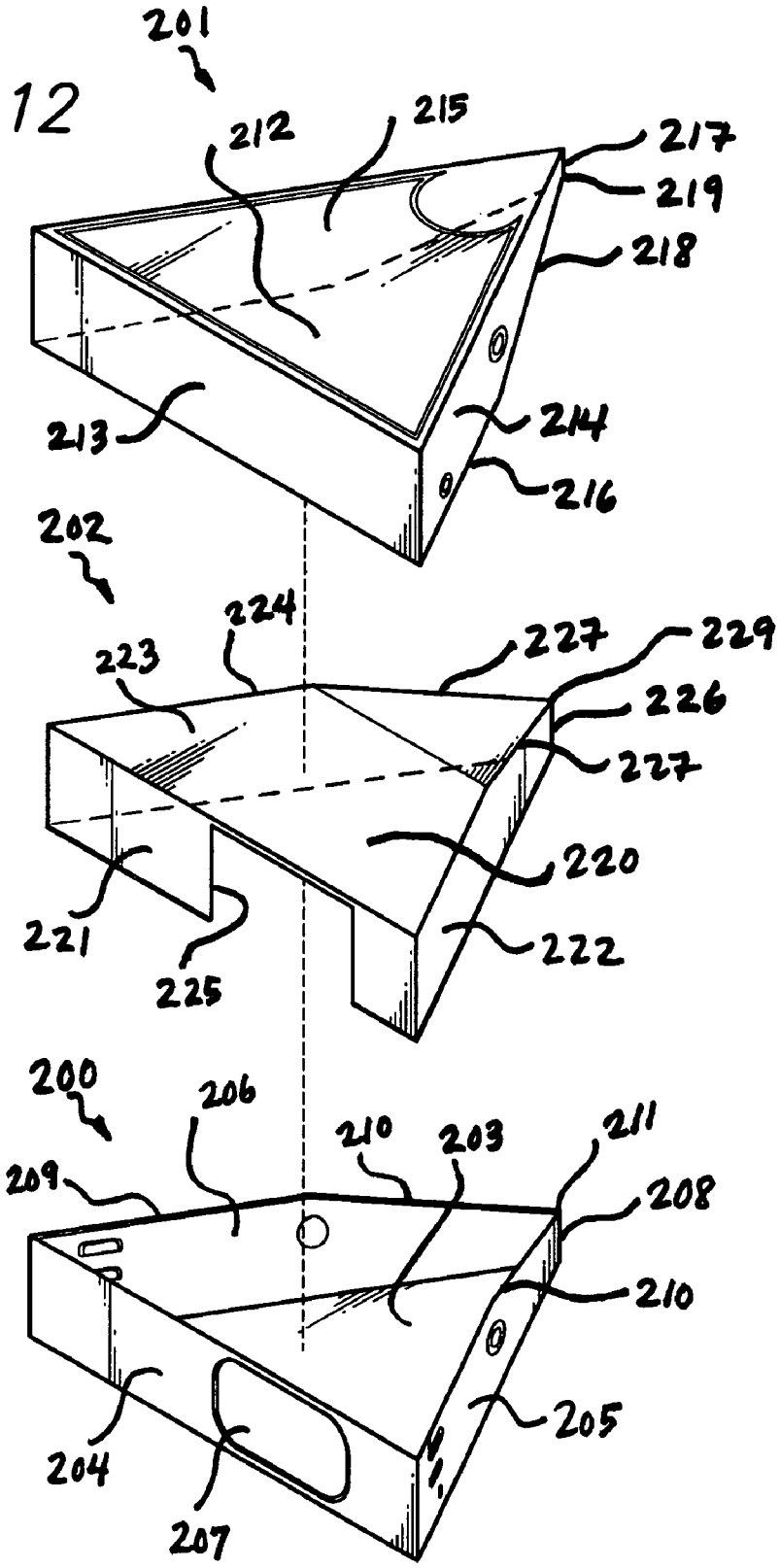
FIG. 12 is an exploded perspective view of a triangular embodiment of the dispenser, showing the cover, the insert, and the base.

Another embodiment is a dispensing device with alternative multi-sided geometric shapes, including but not limited to, for example, triangular, square, rectangular (as shown in FIGS. 1 to 8) or hexagonal. An embodiment of the present dispensing device with multi-sided shapes such as triangular (including scalene, isosceles, equilateral, and right triangles) is broadly comprised of: a base and a cover. Shown in FIG. 12 is a triangular embodiment of the dispenser. Specifically, in this embodiment, the dispenser is broadly comprised of a base 200 and a cover 201, each shaped as a triangular solid. The base 200 has a bottom wall 203, a first side wall 204, a second side wall 205, and a third side wall 206, each side wall having an upper edge 209. The first side wall 204 has an aperture 207. An apex 208 is formed opposite the aperture 207 by the convergence of the second side wall 205 and the third side wall 206. A portion 210 of the upper edge of the second side wall and a portion 210 of the upper edge of the third side wall are angled downwards, such that the resulting upper edge 211 at the convergence of the second and third side walls is lower than the upper edges 209 of the first, second, and third base side walls. The cover 201 has an upper wall 212, a first side wall 213, a second side wall 214, and a third side wall 215, each side wall having a lower edge 216. An apex 217 is formed by the convergence of the second side wall 214 and the third side wall 215. A portion 218 of the lower edge of the second side wall and a portion 218 of the lower edge of the third side wall are angled upwards, such that the resulting lower edge 219 at the convergence of the second and third side walls is higher than the lower edges 216 of the first, second, and third cover side walls. Upon assembly of the cover 201 and base 200, a portion of the base wall is exposed, such that placement of downward pressure on the cover upper wall 212, opposite the aperture 207, elevates the first side wall 213 of the cover, revealing some portion of the aperture in the base side wall, thereby permitting the dispensing of at least some of the contents of the dispenser.

The angled portions 210 and 218 of the base 200 and the cover 201, respectively, allow the first side wall 213 to be elevated when pressure is applied on an area of the cover upper wall 212, thereby revealing the aperture 207 of the base side wall. As will be appreciated by those skilled in this field numerous embodiments may be constructed with corresponding angled portions 210 and 207 of the base and cover, respectively, which are adjusted depending on the size, thickness, and length of the dispensing device, or to vary the degree in which the first side wall 213 is elevated when downward pressure is applied to the cover or base. In alternate embodiments, the angles and lengths of the corresponding angled portions 210 and 218 of the base 200 and the cover 201, respectively, can be increased or decreased, in order to vary the degree in which the aperture 207 is exposed, or to vary the degree in which the cover front wall 213 elevates.

Opening the dispenser of FIG. 12 can be done in several ways one of which is by applying downward pressure on an area of the cover upper wall 212. Opening the dispenser can be done by one finger, by placing the dispenser on a flat surface, or by grasping the container between two opposing fingers, simultaneously pressing with two fingers—with one finger on the on an area of the cover upper wall 212, and another finger on the bottom of the base 200.

Closing the dispenser of FIG. 12 can also be done in several ways, one of which is by applying downward pressure on the front area of the cover 201. The dispenser of FIG. 12 can also be closed by applying pressure on the bottom of the base 200. Closing the dispenser can be also done by one finger, by placing the dispenser on a flat surface, or by grasping the container between two opposing fingers, simultaneously pressing with two opposing fingers—with one finger on the on an area of the cover upper wall 212, and another finger on the bottom of the base 200.

Another embodiment of the present invention is a dispensing device in the shape of a triangle, as described above, with an insert. The insert holds the contents in place, such as in the event the cover is disengaged. Also, small solids such as tablets tend to "stack" inside a dispensing device, and the insert permits the dispensing device to open and close when stacking occurs. This optional insert is preferred if the size of the contents of the dispensing device is small enough to "stack" thereby preventing the depression of the cover onto the base. The insert can also be removably or permanently fixed to the base.

As shown in FIG. 12, the triangular insert 202 fits within the base, has an upper wall 220, a first side wall 221, a second side wall 222, and a third side wall 223, each wall having an upper edge 224. The first side wall 221 has an aperture 225 which corresponds with at least some portion of the aperture 207 in the first base side wall 204 when the insert is placed within the base. An apex 226 is formed opposite the aperture 225 by the convergence of the second side wall and the third side wall. A portion 227 of the upper edge of the second side wall and a portion of the upper edge of the third side wall are angled downwards, such that the resulting upper edge 229 at the convergence of the second and third side walls is lower than the upper edges 224 of the first, second, and third base side walls.

Another embodiment of the present dispensing device comprises a base which is a single piece, wherein the insert and base are formed into a single unitary piece, having at least one aperture on a side wall and having a cover as disclosed in the detailed description herein.

Another embodiment is a dispensing device wherein the bottom wall, side wall, front wall, or rear wall of the base is of curvilinear shape.

Another embodiment is a dispensing device wherein the upper wall, side wall, front wall, or rear wall of the cover is of curvilinear shape.

In each of the foregoing embodiments, the edges of the walls of the cover and the base can be rolled over to form a smooth rolled lip around the entire periphery of the edges. This rolled lip advantageously eliminates any exposed sharp metal edges that might otherwise cut the user.

The present invention also includes a method of assembly of the dispensing device. In this method, the dispensing device is assembled by first acquiring a base, a cover, and an insert (which is optional) in any of the embodiments described above; second, loading the items desired to be dispensed into the base; third (if an insert is desired to be used), placing the insert into the base and over the items to be dispensed; and fourth, engaging the detents so that the cover and base are assembled. This assembly can also be accomplished whether the dispensing device is filled or empty. Alternatively, the items intended to be dispensed can be loaded after assembly, such as through its aperture, while the dispensing device is in its open configuration.

In the embodiment wherein all interacting detents are removably engaged with each other and wherein the insert is removably inserted into the base, the dispensing device can be simply disassembled by disengaging the base and cover and removing the insert from the base. This allows the dispensing device to be reused, and also allows re-filling with the items desired to be dispensed.

Finally, with respect to the composition of the elements making up the dispenser, the base, cover, or insert could be made from, by way of example and without limitation, metal, alloy, plastic, resins, or other suitable material that will permit the dispenser to function for its intended purpose. The base, cover, or insert could be formed as, by way of example and without limitation, metal stampings, thermoformed plastic, by injection molding of synthetic resinous materials such as thermoplastic polyurethane (TPU), or by any other suitable materials and formation methods known in the art. The cover and base can also be embossed, stamped, or printed for decorative purposes or for functional purposes such as indicating where to press to open or close the device.

Although specific embodiments of the invention have been described, various modifications, alterations, alternative constructions, and equivalents are also encompassed within the scope of the invention. The specification and drawings are, accordingly, to be regarded in an illustrative rather than a restrictive sense.

The invention claimed is:

1. A dispenser comprising:

a base, a cover, and an insert;

the base having a bottom wall and a curvilinear side wall having an upper edge;

the base side wall having an aperture;

wherein a portion of the upper edge of the base side wall, opposite the aperture, is angled such that the resulting upper edge of that portion of the base side wall is lower than the remaining upper edge of the base side wall;

the cover having an upper wall and a curvilinear side wall having a lower edge;

wherein a portion of the lower edge of the cover side wall, opposite the aperture, is angled such that the resulting lower edge of that portion of the cover side wall is higher than the remaining lower edge of the cover side wall;

the insert, having an upper wall and a curvilinear side wall with an upper edge;

wherein a portion of the upper edge of the side wall of the insert is angled such that the resulting upper edge of that portion of the insert side wall is lower than the remaining upper edge of the insert side wall;

the insert having an aperture in the curvilinear side wall which corresponds with at least some portion of the aperture in the base side wall when the insert is placed within the base; and upon assembly of the cover, base, and insert, a portion of the base wall is exposed, such that placement of downward pressure on an area of the cover upper wall opposite to the aperture in the base side wall elevates the cover wall, revealing some portion of the aperture in the base side wall, thereby permitting the dispensing of at least some of the contents of the dispenser.

2. The dispenser of claim 1 wherein the base and cover are further comprised of interacting detents.

* * * * *